US010876304B2

(12) United States Patent
Shaw

(10) Patent No.: US 10,876,304 B2
(45) Date of Patent: Dec. 29, 2020

(54) INTERCHANGEABLE BOARD AND BATTEN

(71) Applicant: CertainTeed LLC, Malvern, PA (US)

(72) Inventor: Robert D. Shaw, Parma, MI (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/233,689

(22) Filed: Dec. 27, 2018

(65) Prior Publication Data

US 2019/0383035 A1 Dec. 19, 2019

Related U.S. Application Data

(60) Provisional application No. 62/612,107, filed on Dec. 29, 2017.

(51) Int. Cl.

| | |
|---|---|
| ***E04F 19/04*** | (2006.01) |
| ***E04F 13/08*** | (2006.01) |
| ***E04F 13/072*** | (2006.01) |

(52) U.S. Cl.

CPC ..... *E04F 19/04* (2013.01); *E04F 13/072* (2013.01); *E04F 13/08* (2013.01)

(58) Field of Classification Search

CPC ..... E04F 19/04; E04F 13/072; E04F 13/08; E04F 13/0864; E04F 13/0891; E04F 13/007; E04F 13/18; E04F 13/185; E04F 13/0871; E04F 13/0883; E04F 13/0835; E04B 2/7407; E04B 2002/7468; E04D 3/32; E04D 3/3607; E04D 2003/3617

See application file for complete search history.

(56) References Cited

U.S. PATENT DOCUMENTS

| | | | | | |
|---|---|---|---|---|---|
| 2,234,799 | A * | 3/1941 | Eason | E04D 3/30 | 52/462 |
| 2,796,637 | A | 6/1957 | Miles | | |
| 3,733,767 | A * | 5/1973 | Craik | E04D 3/30 | 52/529 |
| 3,886,709 | A * | 6/1975 | Krah | E04F 13/0803 | 52/460 |
| 4,031,683 | A * | 6/1977 | Walker | E04B 1/54 | 52/536 |
| 4,063,393 | A * | 12/1977 | Toti | E04B 2/7453 | 52/245 |
| 4,228,629 | A * | 10/1980 | Chalmers | E04F 13/12 | 52/460 |
| 4,285,182 | A * | 8/1981 | Dinges | E04D 3/363 | 52/478 |
| 4,406,106 | A * | 9/1983 | Dinges | E04D 3/363 | 428/63 |

(Continued)

*Primary Examiner* — Rodney Mintz
(74) *Attorney, Agent, or Firm* — McDonnell Boehnen Hulbert & Berghoff LLP

(57) ABSTRACT

One aspect of the disclosure is a siding system including a first panel having a first end and a second end, where the second end of the first panel includes a locking clip, and where the second end of the first panel forms a first portion of a channel. The siding system also includes a second panel having a first end and a second end, where the first end of the second panel includes a locking leg sized to engage the locking clip of the first panel, and where the first end of the second panel forms a second portion of the channel when the first panel and the second panel are engaged. The system also includes a batten sized to be removably engaged within the channel.

20 Claims, 9 Drawing Sheets

(56) References Cited

U.S. PATENT DOCUMENTS

| | | | | | |
|---|---|---|---|---|---|
| 4,583,339 | A * | 4/1986 | Cotter | E04F 19/06 | 52/463 |
| 4,982,541 | A | 1/1991 | Winter | | |
| 5,020,293 | A * | 6/1991 | Itagaki | A47F 11/02 | 248/223.41 |
| 5,363,624 | A * | 11/1994 | Cotter | E04D 3/366 | 52/466 |
| 5,694,728 | A * | 12/1997 | Heath, Jr. | E04D 3/32 | 52/518 |
| 7,661,235 | B2 * | 2/2010 | Stoecker | E04F 13/12 | 52/478 |
| 9,309,677 | B1 | 4/2016 | Anic | | |
| 2009/0235612 | A1 | 9/2009 | Shaw et al. | | |
| 2012/0031034 | A1 | 2/2012 | Culpepper | | |
| 2014/0305063 | A1 * | 10/2014 | Kim | E04F 13/0814 | 52/489.1 |
| 2018/0127983 | A1 * | 5/2018 | Roy | E04D 12/004 | |
| 2020/0048912 | A1 * | 2/2020 | Roy | E04B 1/7069 | |

* cited by examiner

INTERCHANGEABLE BOARD AND BATTEN

CROSS-REFERENCE TO RELATED APPLICATIONS

This application claims the benefit of priority of U.S. Provisional Patent Application No. 62/612,107, filed Dec. 29, 2017, which is hereby incorporated herein by reference in its entirety.

BACKGROUND OF THE DISCLOSURE

1. Field of the Disclosure

The present disclosure relates generally to siding products and methods for installing them. The present disclosure relates more particularly to siding, e.g., formed from vinyl, having a simulated board and batten appearance.

2. Technical Background

Traditional board and batten siding is constructed from wood, and involves a repeating series of boards of similar width installed adjacent to one another, usually vertically, with a small gap between each board. A narrower strip of wood, the batten, is then installed over the seams, covering each gap between the larger boards. The result is a siding appearance that is sometimes associated with a colonial or rural structure, such as a barn or a country home.

The appearance of board and batten siding can also be simulated using other siding materials, such as polyvinyl chloride (PVC), typically referred to as vinyl siding. For example, a vinyl siding panel may be extruded into a shape that includes a flat width similar to the board section adjacent to a raised strip that simulates the batten. This vinyl panel then interlocks with an adjacent vinyl panel having the same pattern, and so on. In this type of vinyl board and batten siding system, the batten does not serve the purpose of covering the gap between adjacent boards. Rather, the entire panel is integrally formed, and the board and batten are not separate pieces.

However, a vinyl board and batten siding system may have less flexibility of design than traditional wood board and batten siding. For example, it may be difficult or uneconomical to alter a vinyl extrusion process to vary the height or width of the simulated battens on the vinyl panel. Similarly, it may not be possible to produce a vinyl board and batten panel where the board and the batten portions of the panel are different colors. Moreover, as noted above, the battens are integrally formed with the panels, and thus they are not removable.

Accordingly, what is needed is a simulated board and batten siding system that provides improved variability in its configuration and appearance.

SUMMARY OF THE DISCLOSURE

One aspect of the disclosure is a siding system comprising:

a first panel comprising a first end and a second end, wherein the second end of the first panel comprises a locking clip, and wherein the second end of the first panel forms a first portion of a channel;

a second panel comprising a first end and a second end, wherein the first end of the second panel comprises a locking leg sized to engage the locking clip of the first panel, and wherein the first end of the second panel forms a second portion of the channel when the first panel and the second panel are engaged; and a batten sized to be removably engaged within the channel.

Another aspect of the disclosure is a wall of a structure comprising an exterior sheathing and a siding system as described herein, wherein the first panel is fastened to the exterior sheathing via the fastening strip, wherein the locking leg of the second panel is engaged with the locking clip of the first panel, and wherein the batten is removably engaged within the channel.

Another aspect of the disclosure is a method for installing a siding system as described herein, the method comprising:

fastening the first panel to the exterior sheathing via the fastening strip disposed along the edge of the second end of the first panel;

engaging the locking leg of the second panel with the locking clip of the first panel such that the first panel and second panel form the channel; and removably engaging the batten within the channel.

Another aspect of the disclosure is a method for making a siding system as described herein. The method includes:

extruding a first panel to include a first end and a second end, wherein the second end of the first panel comprises a locking clip, and wherein the second end of the first panel forms a first portion of a channel;

extruding a second panel to include a first end a the second end, wherein the first end of the second panel comprises a locking leg sized to engage the locking clip of the first panel, and wherein the first end of the second panel forms a second portion of the channel when the first panel and the second panel are engaged; and extruding a batten such that the batten is sized to be removably engaged within the channel.

Another aspect of the disclosure is a siding system comprising:

a panel comprising a first end, a second end, and a middle portion positioned between the first end and the second end, wherein the second end of the siding panel comprises a locking clip, and wherein the middle portion forms a channel;

a batten sized to be removably engaged within the channel.

Another aspect of the disclosure is a wall of a structure comprising an exterior sheathing and a siding system as described herein, wherein the first panel is fastened to the exterior sheathing via the fastening strip, and wherein the batten is removably engaged within the channel.

Another aspect of the disclosure is a method for installing a siding system as described herein, the method comprising:

fastening the first panel to the exterior sheathing via the fastening strip disposed along the edge of the second end of the first panel; and removably engaging the batten within the channel.

Another aspect of the disclosure is a method for making a siding system as described herein. The method includes:

extruding a panel to include a first end, a second end, and a middle portion positioned between the first end and the second end, wherein the second end of the panel comprises a locking clip, and wherein the middle portion forms a channel; and extruding a batten such that the batten is sized to be removably engaged within the channel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventor has noted disadvantages of conventional vinyl siding systems that simulate a board and batten appearance. As noted above, the vinyl is extruded to form an integral panel including both the board and batten portions of the siding pattern. The present inventor has noted that this makes it difficult to provide a range of design choices for board and batten siding, particularly with respect to the height, shape, and color of the battens. Because the battens are not separable, they cannot be altered or replaced.

The present inventor has determined that a siding system may be formed that simulates a board and batten appearance, but also includes a removable batten portion. This can provide for the interchangeability of the battens in order to vary their size, shape, color, and generally provide increased variability in the configuration and appearance of the siding system.

Accordingly, one aspect of the disclosure is a siding system including a first panel having a first end and a second end. The second end of the first panel includes a locking clip, and the second end of the first panel forms a first portion of a channel. The siding system also includes a second panel having a first end and a second end. The first end of the second panel includes a locking leg sized to engage the locking clip of the first panel, and the first end of the second panel forms a second portion of the channel when the first panel and the second panel are engaged. The siding system also includes a batten sized to be removably engaged within the channel.

Thus, the interchangeable battens may provide for a greater array of choices for a builder to offer, and a homeowner to choose from, when selecting the appearance of the board and batten siding system. Further, the originally selected battens may be replaced with battens of a different style after the initial installation of the siding system, in order to refresh or update the appearance of the siding. The interchangeability of the battens may also be useful to replace a damaged, marked, or otherwise underperforming portion of the siding system. Other advantages also exist, as further discussed below.

Figure 1:
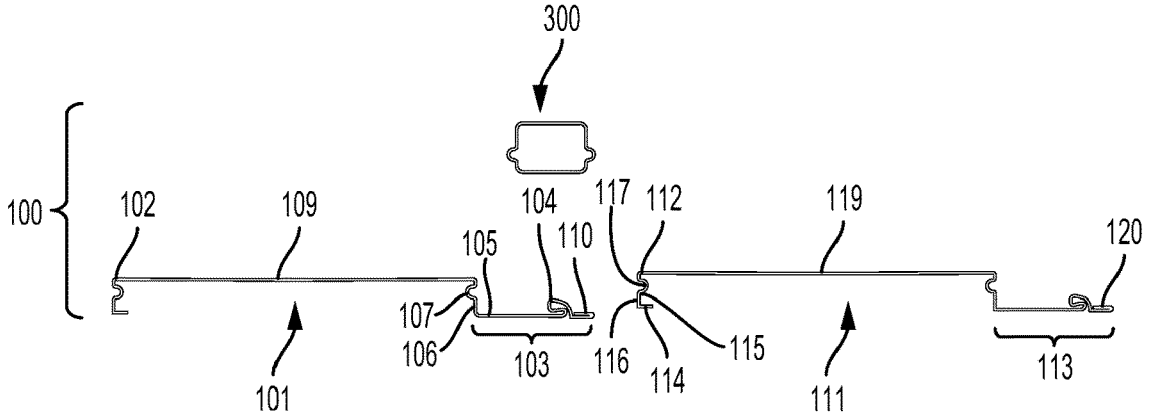
FIG. 1 is a schematic exploded profile view of a siding system according to one embodiment of the disclosure.

Several embodiments of such a siding system are described with respect to FIGS. 1-4 below. For example, FIG. 1 shows a schematic, exploded profile view of a siding system 100 according to one embodiment of the disclosure. The siding system includes a first panel 101 having a first end 102 and a second end 103. The second end 103 includes a locking clip 104 for attachment to an adjacent panel. For instance, the locking clip 104 may take a typical form used in the interconnection of siding panels, as shown in FIG. 1. Other arrangements of the locking clip 104 are also possible.

The first panel 101 may also include a fastening strip 110 disposed along an edge of the second end 103 of the first panel 101. In certain embodiments as otherwise described here, the fastening strip 110 may take the form of a nailing flange, including a series of elongated slots for receiving a nail therethrough. Other arrangements of the fastening strip are also possible.

The second end 103 of the first panel 101 also forms a first portion 105 of a channel 201. For instance, in certain embodiments as otherwise described herein, the second end 103 of the first panel 101 forms a first wall 106 of the channel 201 that is formed when the first panel 101 is engaged with a second panel 111, as can be seen in the example shown in FIGS. 1 and 2.

Accordingly, the siding system 100 includes a second panel 111 including a first end 112 and a second end 113. The first end 112 of the second panel 111 includes a locking leg 114 sized to engage the locking clip 104 of the first panel 101. As noted above with respect to the locking clip 104, the locking leg 114 may take a typical form used in the interconnection of siding panels.

Figure 2:
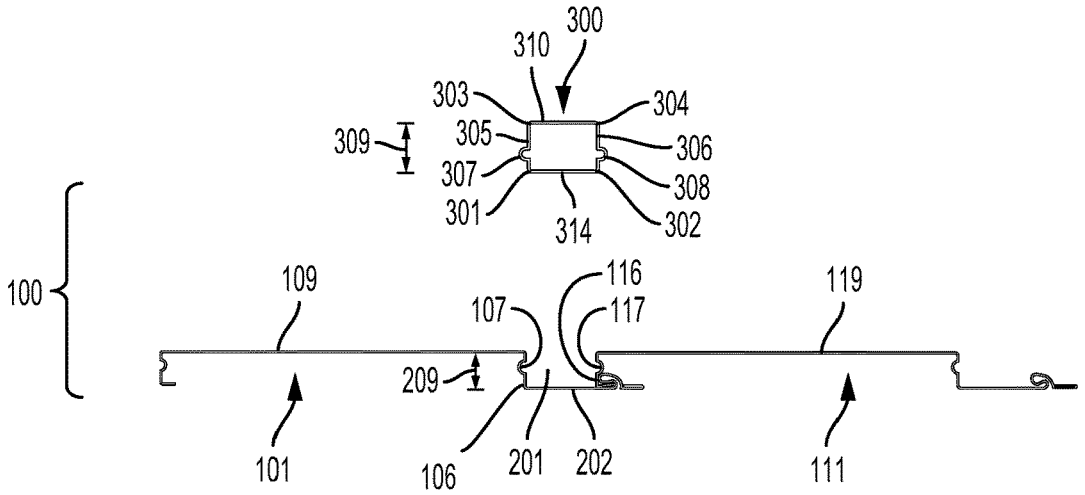
FIG. 2 is a schematic, partially exploded profile view of the siding system according to the embodiment of FIG. 1.

As seen in FIGS. 1 and 2, the first end 112 of the second panel 111 forms a second portion 115 of the channel 201 when the first panel 101 and the second panel 111 are engaged. For example, in certain embodiments as otherwise described herein, the first end 112 of the second panel 111 forms a second wall 106 of the channel 201. In the current example, the first panel 101 also forms the bottom 202 of the channel 201. However, other arrangements are also possible, and may involve the locking clip 104 and the locking leg 114 engaging one another in a different location in relation to the channel 201. In some examples, the first panel 101 and the second panel 111 may be substantially identical, as shown in the example of FIGS. 1 and 2.

Figure 3:
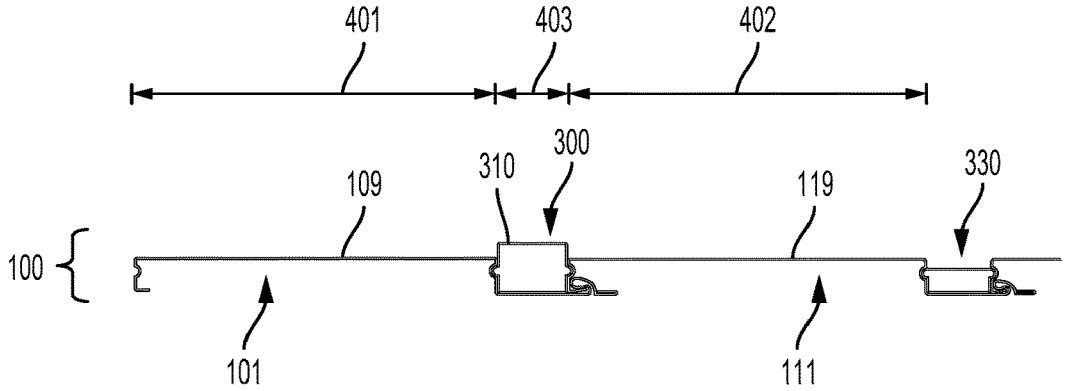
FIG. 3 is a schematic profile view of a siding system according to another embodiment of the disclosure.

The siding system 100 also includes a batten 300 sized to be removably engaged within the channel 201. FIG. 3 shows a schematic profile view of a siding system 100 according to another embodiment of the disclosure, in which the batten 300 is engaged within the channel 201.

In some embodiments, the batten 300 may be engaged within the channel 201 via friction or other mechanical means. As an example, the first wall 106 of the channel 201 may include a first depression 107, as can be seen in FIG. 1. Similarly, the second wall 116 of the channel 201 may include a second depression 117. The batten 300 may include a corresponding first protrusion 307 sized to engage the first depression 107 and a second protrusion 308 sized to engage the second depression 117 when the batten 300 is removably engaged within the channel 201. In the example shown in FIGS. 1-3, the depressions and protrusions have rounded edges at their interface, which may facilitate the insertion and removal of the batten 300. Numerous other arrangements of the interface between the batten 300 and the channel 201 are also possible, allowing the batten 300 to be removably engaged within the channel 201.

Figure 4:
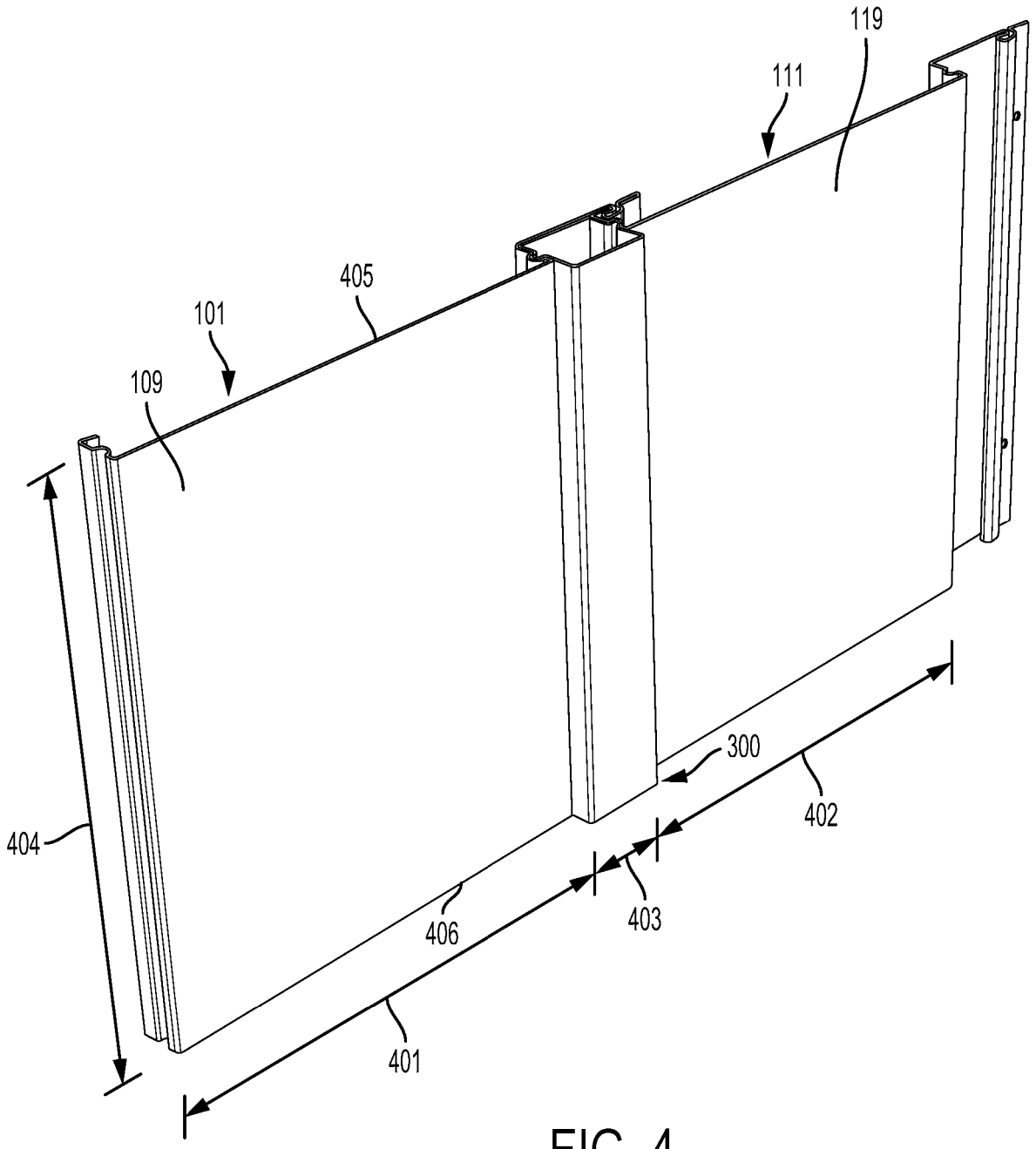
FIG. 4 is a schematic perspective view of a siding system according to another embodiment of the disclosure.

In certain embodiments as otherwise described herein, the first panel 101 may include a substantially planar face 109, as shown in FIGS. 1-3, and which can be seen in the schematic perspective view of a siding system 100 shown in FIG. 4. In some embodiments, the face 109 of the first panel 101 may include a width 401 between 8 inches and 24 inches (e.g., 12 inches). The second panel 111 may have a substantially identical width 402 to the first panel 101. Further, the batten 300 may have a width between 1 inch and 4 inches (e.g., 2 inches). In some other examples, the first and second panels 101, 111 may have a different width, which may introduce variation into the overall pattern of the siding system 100. Further, the width 403 of the batten 300 may vary from batten to batten throughout the siding system 100. In this regard, numerous combinations and permutations for the widths of the panels and battens are possible.

Referring again to FIG. 4, the first panel 101 may include a height 404 between 10 and 20 feet (e.g., 12 feet) between a top end 405 and a bottom end 406 of the first panel 101. Both the second panel 111 and the batten 300 may have a substantially similar height.

In certain embodiments as otherwise described herein, the channel 201 may include a depth 209 extending approximately perpendicular to the face 109 of the first panel 101 in a first direction. An example of the depth 209 may be seen most clearly in the embodiment shown in FIG. 2.

As noted above, in a traditional board and batten application constructed from wood, the battens are placed on top of the boards, covering the gaps at each seam between adjacent boards. Consequently, the battens stand off from the face of the boards, creating a discontinuous surface. Consistent with this traditional appearance, the batten 300 in some examples discussed herein may include a height 309 greater than the depth 209 of the channel 201 such that, when the batten 300 is removably engaged within the channel 201, a face 310 of the batten 300 stands off from the face 109 of the first panel 101 in a second direction opposite the first direction. For example, the face 310 of the batten 300 may stand off between 0.25 and 1.50 inches (e.g., 0.5 inches) from the face 109 of the first panel 101. Other examples are also possible.

Alternatively, in some embodiments the size and shape of the batten 300 may create a non-traditional appearance. For instance, the batten 300 may include a height 309 less than the depth of the channel 201 such that, when the batten 300 is removably engaged within the channel 201, the face 310 of the batten 300 is recessed from the face 109 of the first panel 101 in the first direction. FIG. 3 shows an example of a second batten 330 having this recessed configuration.

The siding system 100 may include battens 300 having other configurations as well. For instance, in some embodiments, such as the one shown in FIGS. 1 and 2, the batten 300 may include a rectangular cross-section having two substantially parallel legs, a first leg 305 and a second leg 306. The legs 305, 306 may include the protrusions 307, 308 as discussed above, or some other interface for removably engagement within the channel 201. Additionally, the legs 305, 306 may be connected therebetween at a respective first end 303, 304 of each leg by the face 310 of the batten 300. Further, the legs 305, 306 may be further connected therebetween at a respective second end 301, 302 of each leg by a backside 314 of the batten 300.

Figure 5:
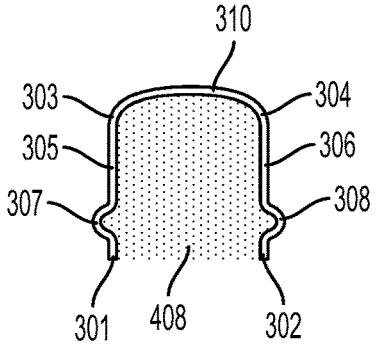
FIG. 5 is a schematic profile view a batten according to another embodiment of the disclosure.

FIG. 5 is a schematic profile view a batten 300 according to another embodiment of the disclosure. In the example of FIG. 5, the batten 300 includes a U-shaped cross-section having two substantially parallel legs, the first leg 305 and the second leg 306. As above, the legs 305, 306 may be connected therebetween at the respective first end 303, 304 of each leg by the face 310 of the batten 300, which is substantially perpendicular to the two legs. However, the batten 300 of FIG. 5 does not include the backside 314, and thus the respective second ends 301, 302 of the legs 305, 306 are not directly connected.

In certain embodiments as otherwise described herein, the batten 300 may include an insert, such as the insert 408 shown in FIG. 5, positioned between the legs 305, 306 of the batten 300. The insert 408 may be, for instance, a foam core insert, and may substantially conform to the cross-section of the batten 300. In some applications, the insert 408 may increase the rigidity of the batten 300 and/or provide insulation for the siding system 100 at the point of the batten 300, among other possible benefits. Alternatively, the batten 300 may be substantially hollow between the legs 305, 306 of the batten 300, as shown in FIGS. 1 and 2 and other embodiments discussed further below.

In some implementations where the batten 300 has a hollow cross-section, the batten 300 may be utilized as a conduit for other systems. For instance, an electrical or telecommunications cable that may otherwise be secured to the exterior face of a structure might be routed through the hollow batten 300 instead. This may offer the cable a measure of protection over a standard, exposed installation. Other mechanical, electrical, plumbing, or drainage systems may utilize the hollow batten 300 as a conduit as well, if it is compatible with such systems.

In some examples, in order to facilitate the removable engagement of the batten 300 within the channel 201, at least a portion of the first leg 305 and at least a portion of the second leg 306 of the batten 300 may be resiliently movable toward each other. For instance, in the example batten 300 shown in FIG. 5, the second end 301 of the first leg 305 and the second end 302 of the second leg 306 may be resiliently movable toward each other. This may allow the legs to be urged together when the batten 300 is being inserted or removed from the channel 201, thereby allowing the protrusions 307, 308 to more easily disengage from the depressions 107, 117 in the channel 201.

Referring back to the batten 300 shown in the example of FIGS. 1 and 2, the second ends 301, 302 of the legs 305, 306 might not be resiliently movable toward each other, due to the presence of the backside 314 of the batten 300. Nonetheless, the middle portion of the legs 305, 306, between the respective ends of the legs, may be resiliently movable toward each other. Thus, a similar effect as above may be achieved, wherein the protrusions 307, 308 may be urged toward each other to facilitate the insertion and removal of the batten 300. After which, the batten 300 may return to its original shape.

In some cases wherein the batten 300 includes an insert 408, as discussed above, the material of the insert 408 may be resiliently compressible. In this way, the insert 408 may flex in conjunction with the legs 305, 306 of the batten 300. In other examples where the insert 408 might not be compressible, the insert 408 might not fully correspond to the internal cross-section of the batten 300. For instance, a relatively rigid insert 408 may instead include slight cutaways to allow for the legs 305, 306 to flex inward, as described above.

Figure 6:
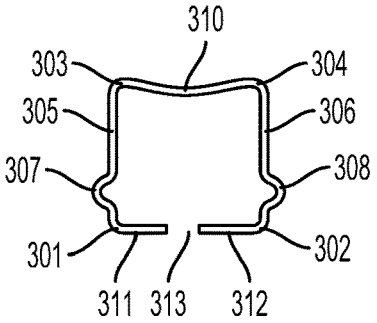
FIG. 6 is a schematic profile view a batten according to another embodiment of the disclosure.

FIG. 6 is a schematic profile view a batten 300 according to another embodiment of the disclosure. The batten 300 shown in FIG. 6 is similar to the batten 300 of FIG. 5, but further includes a first wing 311 extending toward the second leg 306 from the second end 301 of the first leg 305. The batten 300 also includes a second wing 312 extending toward the first leg 305 from the second end 302 of the second leg 306, such that the first and second wings 311, 312 are separated by a gap 313. In this arrangement, the second ends of legs 305, 306 may be resiliently movable toward each other, as discussed above with respect to FIG. 5. However, this movement may be limited by the wings 311, 312, which may contact each other once the gap 313 is closed. The gap 313 separating the first and second wings 311, 312 may be, for example, ⅛ of an inch, and may vary in size depending on the width of the batten 300, the height of the batten 300, or the presence of an insert 408, among other factors.

Figure 7:
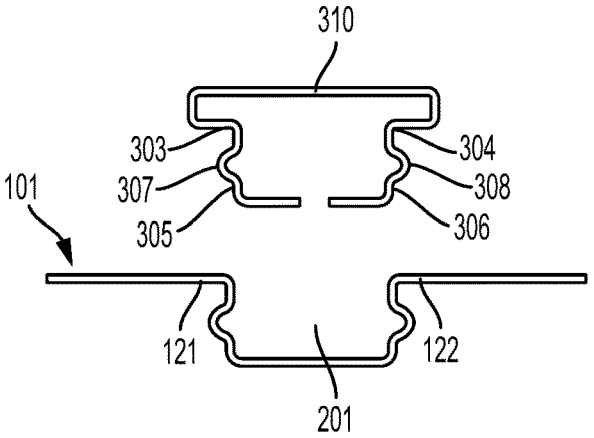
FIG. 7 is a schematic profile view a batten according to another embodiment of the disclosure.

Another example variation is shown in FIG. 7, which shows a schematic profile view of a batten 300 according to another embodiment of the disclosure. The batten 300 includes a T-shaped cross-section with two substantially parallel legs 305, 306, which are connected therebetween by the face 310 of the batten 300, as discussed in other examples above. However, the face 310 of the batten 300 shown in FIG. 7 also extends a distance beyond each respective leg such that, when the batten 300 is removably engaged within the channel 201, a simplified, schematic view of which is shown in FIG. 7, the face 310 of the batten 300 covers a portion 121 of the first panel 101 adjacent to the channel 201. Similarly, the face 310 covers a portion 122 of the second panel 111 adjacent to the channel 201.

The overall width of the face 310 shown in FIG. 7 may vary. However, the legs 305, 306 may remain the same distance apart as the example battens 300 shown in FIG. 5 or FIG. 6, for instance. Advantageously, this may allow the apparent width of the batten 300 in the siding system 100 to be adjusted, while maintaining the same width of the channel 201, and thus the same configuration of the first panel 101 and the second panel 111. Further, the standoff from the face 109 of the first panel 101 can be adjusted as well in the example of FIG. 7, by increasing the height of the face 310.

Additional variations in the shape and appearance of the batten 300 are also possible. For instance, the face 310 of the battens shown in FIGS. 1-3 is substantially parallel with the face 109 of the first panel 101, whereas the batten 300 of FIG. 5 has a convex face 310, and the batten 300 of FIG. 6 has a concave face 310. Further, battens may be formed from different materials, which may lead to a different appearance, and they may otherwise have different colors, finishes, or other ornamentation. Numerous other examples also exist.

As noted above, the siding system 100 may provide for a wider array of design choices when initially selecting and installing the system. Yet another advantage of the siding system 100 includes the removability of a first batten 300 from the channel 201, which may have a first height, a first cross-sectional shape, and a first color, among other attributes. The siding system 100 may include a second batten sized to be removably engaged within the same channel 201, having at least one of a second height different form the first height, a second cross-sectional shape different from the first cross-sectional shape, and a second color different from the first color.

In some embodiments, and unlike the examples shown in FIGS. 1-4, the channel 201 may be formed entirely within one panel of the siding system 100. Such an example is shown in the schematic profile view of FIG. 7, where the channel 201 does not include either end of the panel. Rather, the channel 201 may be formed in a middle portion of the panel, between the first end and the second end. In this configuration, the position of the channel 201 and the batten 300, once engaged within the channel 201, is separate from the lap joint between the first panel 101 and the second panel 111. In this regard, the second end 103 of the first panel 101 and the first end 102 of the second panel 111 may be formed without including a portion of the channel 201. In such an implementation, numerous possible arrangements for engagement of the locking clip 104 and the locking leg 114 are possible. Further, a siding system 100 in which the channel 201 is formed within a single panel may otherwise include any (e.g., all) of the variations and alternative arrangements discussed herein regarding the siding system 100.

Further, some implementations of the siding system 100 may include channels formed according to both of the embodiments discussed above. Namely, a first channel may be formed by the engagement of the first panel 101 and the second panel 111, as shown in the examples of FIGS. 1-4, and a second channel may be formed in a middle portion of the first siding panel 101, such as the example shown in FIG. 7. A siding system 100 with this configuration may be advantageous where a relatively close batten spacing is desired, for instance, as it may allow for the number of battens to be increased (i.e., the spacing between battens to be decreased) without a corresponding increase in the number of panels that would need to be positioned on the wall, fastened to the wall, and then engaged with one another.

In certain embodiments as otherwise described herein, the siding system 100 may include additional features to engage the batten 300 within the channel 201. For instance, the batten 300 may include an aperture 315 through at least one of (e.g., both of) the first leg 305 and the second leg 306. Further, at least one of (e.g., both of) the walls 106, 116 of the channel 201 may include an aperture 123 positioned to be substantially aligned with the aperture 315 in the batten 300 when the batten 300 is removably engaged within the channel 201. Such an example can be seen in FIG. 8, which shown a schematic, exploded perspective view of a siding system 100 according to another embodiment of the disclosure.

Figure 8:
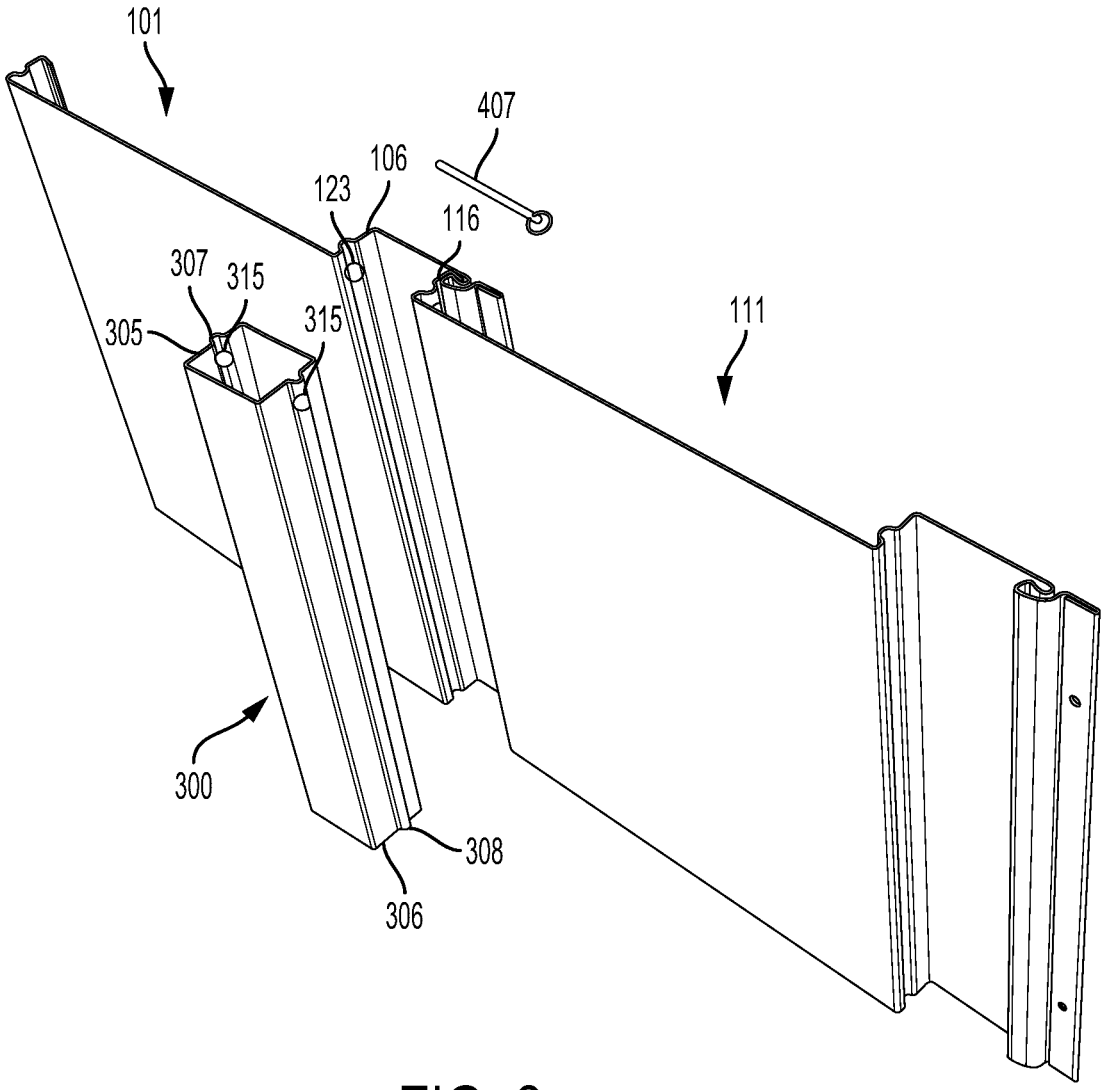
FIG. 8 is a schematic, exploded perspective view of a siding system according to another embodiment of the disclosure.

As shown in FIG. 8, the siding system 100 may further include a pin 407 sized to be removably inserted through the substantially aligned apertures 315, 123 of the batten 300 and the channel wall(s) 106, 116 so as to oppose a longitudinal movement of the batten 300 with respect to the channel 201. In some examples, this may help to decrease the possibility that the batten 300 may slide out of place within the channel 201, due to the weight of the batten 300, the thermal contraction of the components of the siding system 100, among other possibilities. Other systems that may help to oppose a longitudinal movement of the batten 300 are also possible.

In the example siding system 100 shown in FIG. 8, the pin 407 may be inserted behind the face of the first panel 101 or the second panel 111 during installation. However, it may be desirable for the pin 407 to remain accessible, without having to remove either the first or second panel, so as to facilitate the removal of the batten 300 discussed above. Thus, in some embodiments the apertures 315, 123 and the pin 407 may be located at the top end of the batten 300. Further, an eave located above the siding system 100 may include a movable portion that allows access to the top of the siding system 100. Other examples are also possible.

The siding system 100 has been discussed above with respect to the individual components thereof, which can be seen individually in FIG. 1. One of ordinary skill in the art will recognize that these do not necessarily need to be engaged with each other or installed for a full understanding of the current disclosure. Nonetheless, a further discussion of the installed siding system 100, and the installation of the siding system 100, is included below.

Figure 9:
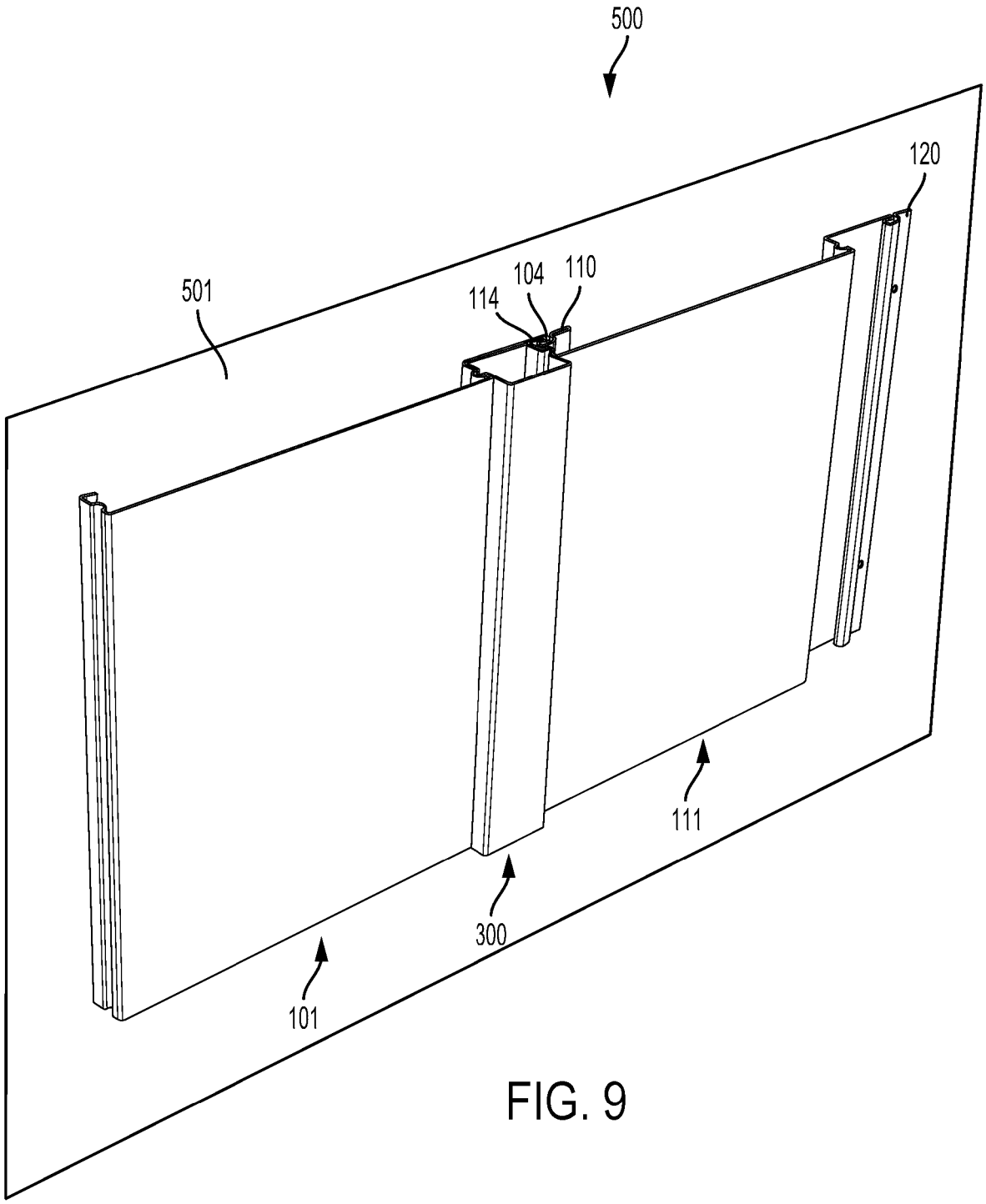
FIG. 9 is a schematic diagram of a partially installed siding system according to another embodiment of the disclosure.

FIG. 9 is a schematic diagram of a partially installed siding system 100 according to another embodiment of the disclosure. In particular, FIG. 9 shows a portion of a wall 500 of a structure. The wall 500 includes an exterior sheathing 501 and the siding system 100 discussed herein attached thereto. The first panel 101 is fastened to the exterior sheathing 501 via the fastening strip 110. Further, the locking leg 114 of the second panel 111 is engaged with the locking clip 104 of the first panel 101. Further the batten 300 is removably engaged within the channel 201. The second panel 111 is also fastened to the exterior sheathing 501 via a second fastening strip 120 disposed along an edge of the second end 113 of the second panel 111.

Figure 10:
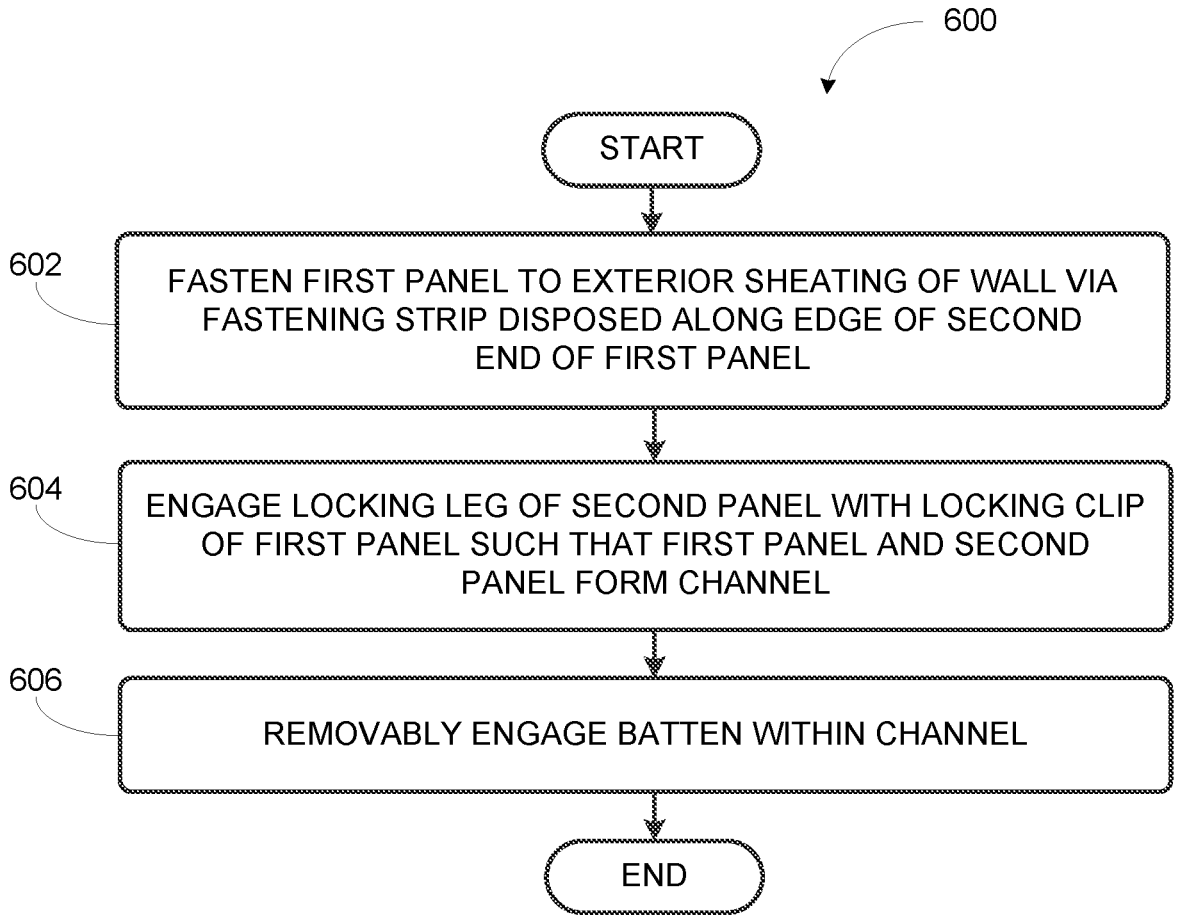
FIG. 10 is a block diagram of a method for installing a siding system onto a wall of a structure according to another embodiment of the disclosure.

FIG. 10 is a block diagram of a method 600 for installing a siding system, such as the siding system 100 discussed herein, onto a wall of a structure according to another embodiment of the disclosure.

At block 602, the method 600 includes fastening a first panel, such as the first panel 101 discussed above, to the exterior sheathing 501, as can be seen in FIG. 9. The first panel 101 may be fastened to the exterior sheathing 501, for instance, via nails driven through slots in the fastening strip 110 that is disposed along the edge of the second end 103 of the first panel 101.

At block 604, the method 600 includes engaging the locking leg 114 of the second panel 111 with the locking clip 104 of the first panel 101 such that the first panel 101 and second panel 111 form the channel 201. The engagement of the locking leg 114 with the locking clip 104 may effectively secure the first end 112 of the second panel 111 to the first panel 101, and thus the exterior sheathing 501, such that additional fasteners are not necessary to hold the two panels together. In some implementations, the second end 113 of the second panel 111 may be fastened to the exterior sheathing 501 via the fastening strip 120 before the batten 300 is engaged. However, in some other implementations, the second end 113 of the second panel 111 may be fastened to the exterior sheathing 501 after the batten 300 is engaged, as discussed below.

At block 606, the method 600 includes removably engaging the batten 300 within the channel 201. In certain embodiments as otherwise described herein, and as discussed above, removably engaging the batten 300 within the channel 201 may include resiliently moving at least a portion of each leg 305, 306 of the batten 300 toward each other. Further, removably engaging the batten 300 within the channel 201 may include engaging one or more protrusions 307, 308 that extend from the respective walls 304, 305 of the batten 300 with corresponding depression(s) in the walls 106, 116 of the channel 201, as noted above.

In some implementations, the positioning of the second panel 111 when it is fastened to the exterior sheathing 501 may affect the removable engagement of the batten 300 within the channel 201. In particular, the width of the channel 201 may be based on the position of the second panel 111 with respect to the first panel 101, as can be seen in the example shown in FIGS. 1-3. Further, the engagement of the locking leg 114 with the locking clip 104 may allow for some movement between the first panel 101 and second panel 111, to allow for thermal expansion and contraction, for instance.

Therefore, it may be possible in some examples that variations in the fastening position of the second panel 111 with respect to the first panel 101 may result in a width of the channel 201 that is slightly narrower than desired, which might make the batten 300 difficult to insert into the channel 201. Conversely, the second panel 111 may be installed in a position such that the width of the channel 201 may be slightly wider than desired, which may result in the batten 300 being engaged within the channel more loosely than desired.

Therefore, in some implementations, it may be desirable to fasten the second panel 111 to the exterior sheathing 501 via the fastening strip 120 after removably engaging the batten 300 within the channel 201. In this way, the width of the channel 201 may be established with the batten 300 in place, with potential movements due to thermal expansion accounted for. This may increase the likelihood of a consistent width as the channel 201 is repeated throughout the installed siding system 100.

As discussed above, one advantage of the siding system 100 is the removability of a first batten 300, which may have a first height, a first cross-sectional area, and a first color, and interchanging it with a second batten 300 of a different shape or style. Accordingly, in certain embodiments as otherwise described herein, the method 600 may include removing the first batten 300 from the channel 201, and then removably engaging a second batten 300 within the channel 201. The second batten 300 may include at least one of (e.g., all of) a second height different from the first height, a second cross-sectional shape different from the first cross-sectional shape, and a second color different from the first color.

In some implementations, as noted above, the batten 300 may include additional features to engage the batten 300 within the channel 201. For instance, and as shown in FIG. 8, the batten 300 may include the aperture(s) 315 in the wall(s) 304, 305, and the channel 201 may include the aperture(s) 123 in the walls 106, 116. In such an implementation, the method 600 may also include inserting the pin 407 through the substantially aligned apertures 315, 123 of the batten 300 and the channel 201 so as to oppose a longitudinal movement of the batten 300 with respect to the channel 201. Additionally, removing the batten 300 as discussed above may further involve removing the pin 407.

Figure 11:
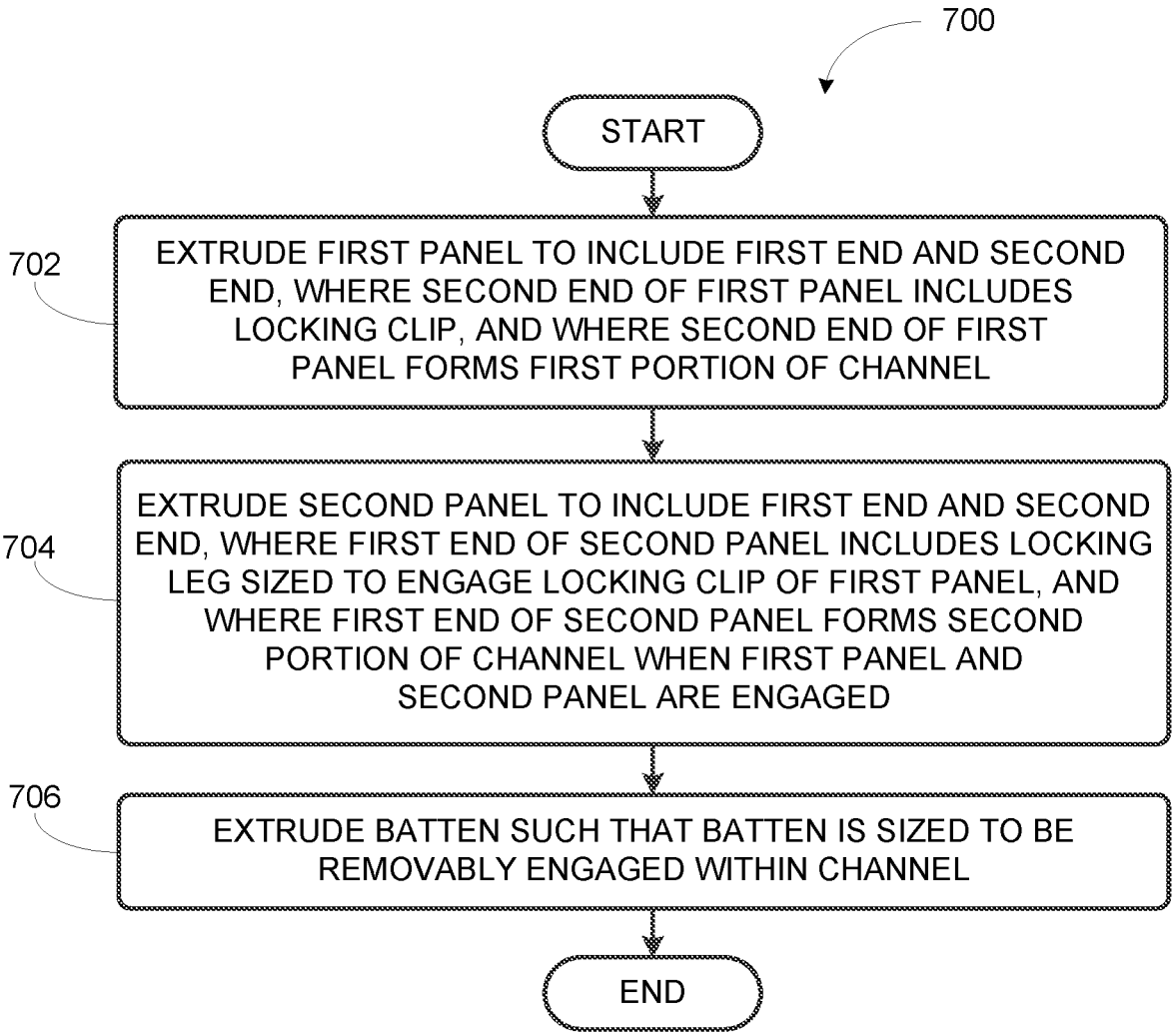
FIG. 11 is a block diagram of a method for making a siding system according to another embodiment of the disclosure.

FIG. 11 is a block diagram of a method 700 for making a siding system, such as the siding system 100 discussed herein, according to another embodiment of the disclosure.

At block 702, the method 700 may involve extruding a first panel, such as the first panel 101 discussed herein, to include a first end 102 and a second end 103. The extrusion discussed at block 702, and elsewhere throughout this disclosure, may involve the extrusion of a relatively flat sheet, followed by one or more post-extrusion forming processes. These may include the use of one or more sizing dies, thermoforming, and/or vacuum forming, among other possibilities. For instance, the second end 103 of the first panel 101 may be formed to include a locking clip 104. Further, the second end 103 of the first panel 101 forms a first portion 105 of a channel 201.

At block 704, the method 700 may involve extruding a second panel, such as the second panel 111 discussed herein, to include a first end 112 and a second end 113. The first end 112 of the second panel 111 may include a locking leg 114 sized to engage the locking clip 104 of the first panel 101. Additionally, the second panel 111 may be extruded such that the first end 112 of the second panel 111 forms a second portion 115 of the channel 201 when the first panel 101 and the second panel 111 are engaged, as noted above.

At block 706, the method 700 may involve extruding a batten, such as the batten 300 discussed herein, such that the batten 300 is sized to be removably engaged within the channel 201. The batten 300 may take a number of different forms, as can be seen in the examples shown in FIGS. 1-3 and FIGS. 5-8.

Figure 12:
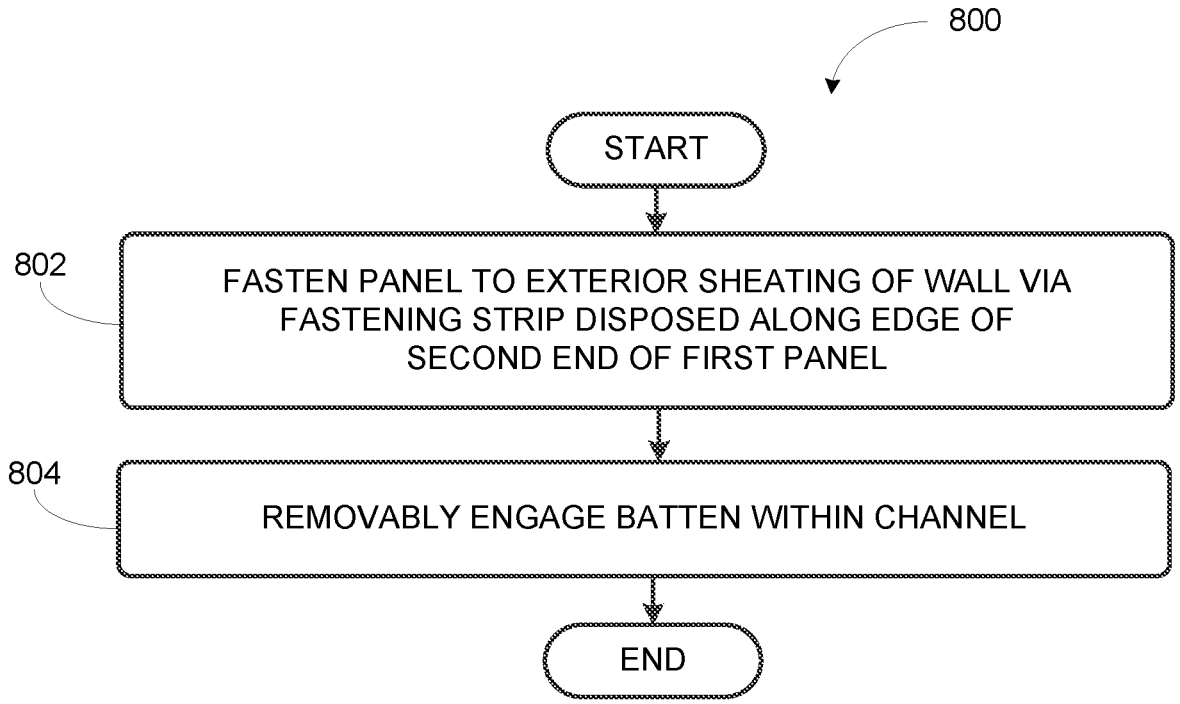
FIG. 12 is a block diagram of a method for installing a siding system onto a wall of a structure according to another embodiment of the disclosure.

FIG. 12 is a block diagram of a method 800 for making a siding system, such as the siding system 100 discussed herein, according to another embodiment of the disclosure.

At block 802, the method 800 includes fastening a panel to the exterior sheathing 501. For instance, and unlike the example discussed above with respect to the method 600, the panel 101 according to method 800 may include a channel 201 formed entirely within the panel 101. The panel 101 may be fastened to the exterior sheathing 501, for instance, via nails driven through slots in the fastening strip 110 that is disposed along the edge of the second end 103 of the first panel 101.

At block 804, the method 800 includes removably engaging the batten 300 within the channel 201. In certain embodiments as otherwise described herein, and as discussed above, removably engaging the batten 300 within the channel 201 may include resiliently moving at least a portion of each leg 305, 306 of the batten 300 toward each other. Further, removably engaging the batten 300 within the channel 201 may include engaging one or more protrusions 307, 308 that extend from the respective walls 304, 305 of the batten 300 with corresponding depression(s) in the walls 106, 116 of the channel 201, as noted above.

Figure 13:
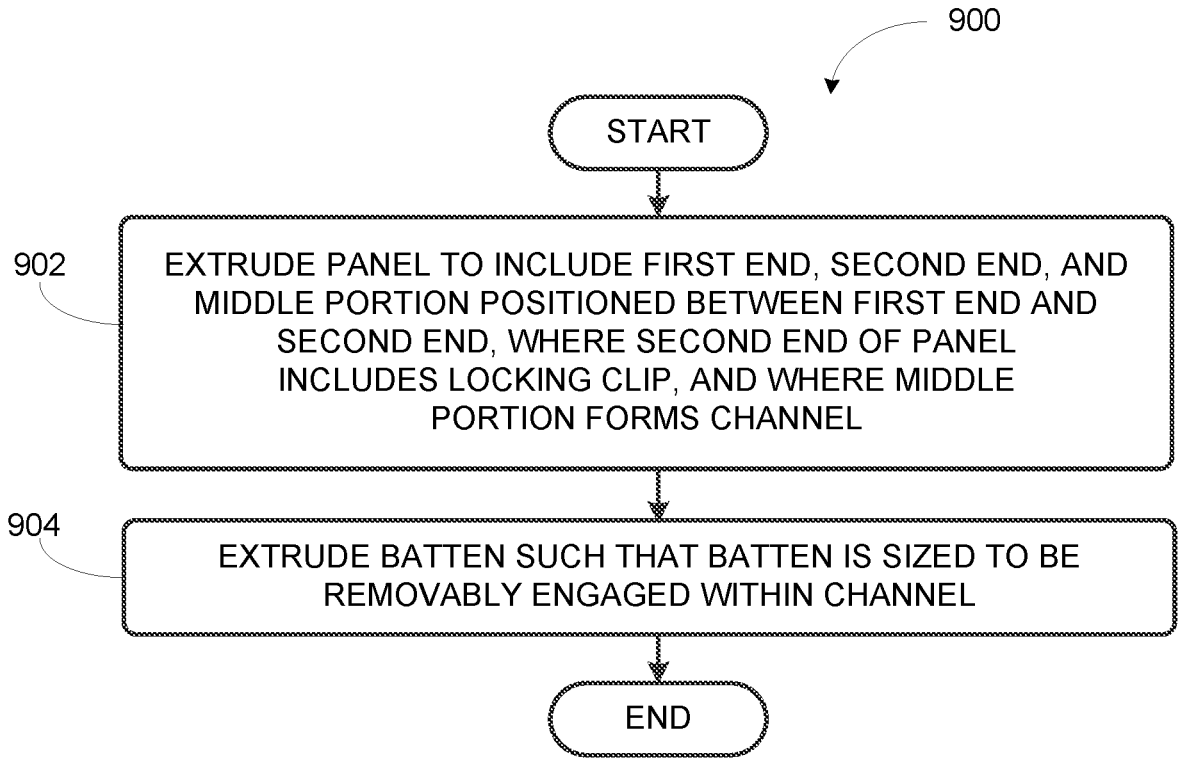
FIG. 13 is a block diagram of a method for making a siding system according to another embodiment of the disclosure.

FIG. 13 is a block diagram of a method 900 for making a siding system, such as the siding system 100 discussed herein, according to another embodiment of the disclosure.

At block 902, the method 900 may involve extruding a panel, such as the panel 101 according to some of the examples discussed above. In particular, the panel 101 may include a first end 102, a second end 103, and a middle portion positioned between the first end 102 and the second end 103. The second end 103 of the panel 101 may include a locking clip 104, as discussed above. Further, extruding the middle portion of the panel 101 may include forming a channel 201.

At block 904, the method 900 may involve extruding a batten, such as the batten 300 discussed herein, such that the batten 300 is sized to be removably engaged within the channel 201. The batten 300 may take a number of different forms, as can be seen in the examples shown in FIGS. 1-3 and FIGS. 5-8.

Conventional methodologies for siding fabrication and construction can be used in the making and installation of the siding system as described herein. While one preferred material for making the sidings of the disclosure is vinyl, the person of ordinary skill in the art will appreciate that other materials, such as other polymeric materials, can be used.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding system comprising:

a first panel comprising a first end and a second end, wherein the second end of the first panel comprises a locking clip, and wherein the second end of the first panel defines a first portion of a channel;

a second panel comprising a first end and a second end, wherein the first end of the second panel comprises a locking leg configured to engage the locking clip of the first panel, and wherein, in an engaged configuration of the first panel and the second panel, the first end of the second panel defines a second portion of the channel; and a batten configured to be removably engaged within the channel, wherein the batten comprises a first leg and a substantially parallel second leg connected therebetween at a respective first end of each leg by a face of the batten, the first leg and the second leg defining a void space therebetween, the batten further comprising a first wing extending toward the second leg from a second end of the first leg, and a second wing extending toward the first leg from a second end of the second leg, such that the first and second wings are separated by a gap.

2. The siding system of claim 1, wherein the second end of the first leg and the second end of the second leg are resiliently movable toward each other.

3. The siding system of claim 1, wherein the batten is substantially hollow between the first leg and the second leg.

4. The siding system of claim 1, wherein the batten includes a foam core insert disposed in the void space between the first leg and the second leg.

5. A siding system comprising:

a first panel comprising a first end and a second end, wherein the second end of the first panel comprises a locking clip, and wherein the second end of the first panel defines a first portion of a channel;

a second panel comprising a first end and a second end, wherein the first end of the second panel comprises a locking leg configured to engage the locking clip of the first panel, and wherein, in an engaged configuration of the first panel and the second panel, the first end of the second panel defines a second portion of the channel such that the channel has a depth extending to a bottom of the channel; and a batten including first and second legs connected by a face, the first and second legs defining a void space therebetween, wherein the batten is configured to be removably engaged within the channel and with the face of the batten opposite the bottom of the channel.

6. The siding system of claim 5, wherein the first panel comprises a substantially planar face, wherein the depth of the channel extends approximately perpendicular to the face of the first panel in a first direction, and wherein the batten comprises a height greater than the depth of the channel such that, when the batten is removably engaged within the channel, the face of the batten stands off from the face of the first panel in a second direction opposite the first direction.

7. The siding system of claim 5, wherein the first panel comprises a substantially planar face, wherein the channel comprises a depth extending approximately perpendicular to the face of the first panel in a first direction, and wherein the batten comprises a height less than the depth of the channel such that, when the batten is removably engaged within the channel, a face of the batten is recessed from the face of the first panel in the first direction.

8. The siding system of claim 5, wherein the batten comprises a U-shaped cross-section with the first and second legs being two substantially parallel legs connected therebetween at a respective first end of each leg by the face of the batten, wherein the face of the batten is substantially perpendicular to the two legs.

9. The siding system of claim 5, wherein the batten comprises a rectangular cross-section with the first and second legs being two substantially parallel legs connected therebetween at a respective first end of each leg by the face of the batten, and wherein the legs are further connected therebetween at a respective second end of each leg by a backside of the batten.

10. The siding system of claim 5, wherein the batten comprises a T-shaped cross-section with the first and second legs being two substantially parallel legs connected therebetween at a respective first end of each leg by the face of the batten, wherein the face of the batten extends a distance beyond each respective leg such that, when the batten is removably engaged within the channel, the face of the batten covers a respective portion of the first panel and the second panel adjacent to the channel.

11. The siding system of claim 5, wherein at least a portion of the first leg and at least a portion of the second leg of the batten are resiliently movable toward each other.

12. The siding system of claim 5, wherein the batten comprises an aperture through at least one of the first and second legs, wherein at least one of the walls of the channel comprise an aperture positioned to be substantially aligned with the aperture(s) in the batten when the batten is removably engaged within the channel, and wherein the siding system further comprise a pin sized to be removably inserted through the aperture(s) of the batten and the channel wall(s) so as to oppose a longitudinal movement of the batten with respect to the channel.

13. The siding system of claim 5, wherein the batten is a first batten having a first height, a first cross-sectional shape, and a first color, and wherein the siding system further comprises:

a second batten sized to be removably engaged within the channel, wherein the second batten comprises at least one of i) a second height different from the first height, ii) a second cross-sectional shape different from the first cross-sectional shape, and iii) a second color different from the first color.

14. The siding system of claim 5, wherein the batten is substantially hollow between the first leg and the second leg.

15. The siding system of claim 5, wherein the batten includes a foam core insert disposed in the void space between the first leg and the second leg.

16. The siding system of claim 5, wherein the second end of the first panel forms a first wall of the channel, and wherein the first end of the second panel forms a second wall of the channel positioned opposite the first wall.

17. The siding system of claim 16, wherein the first wall of the channel comprises a first depression, wherein the second wall of the channel comprises a second depression, and wherein the batten comprises a first protrusion sized to engage the first depression and a second protrusion sized to engage the second depression when the batten is removably engaged within the channel.

18. A wall of a structure comprising an exterior sheathing and the siding system of claim 5 attached thereto, wherein the first panel is fastened to the exterior sheathing via a fastening strip, wherein the locking leg of the second panel is engaged with the locking clip of the first panel such that an opening of the channel is opposite the exterior sheathing, and wherein the batten is removably engaged within the channel.

19. A method of installing the wall according to claim 18, the method comprising:

fastening the first panel to the exterior sheathing via the fastening strip disposed along the edge of the second end of the first panel;

engaging the locking leg of the second panel with the locking clip of the first panel such that the first panel and second panel form the channel; and removably engaging the batten within the channel.

20. The method of claim 19, further comprising:

after removably engaging the batten within the channel, fastening the second panel to the exterior sheathing via a fastening strip disposed along an edge of the second end of the second panel.

* * * * *